United States Patent [19]

Nakamura

[11] Patent Number: 4,928,964

[45] Date of Patent: May 29, 1990

[54] REEL DRIVING DEVICE FOR USE IN THE SLOT MACHINE

[75] Inventor: Kikuo Nakamura, Iruma, Japan

[73] Assignee: Sigma Incorporated, Tokyo, Japan

[21] Appl. No.: 265,711

[22] Filed: Nov. 1, 1988

[30] Foreign Application Priority Data

Nov. 13, 1987 [JP] Japan ..... 62-287928

[51] Int. Cl.[5] ..... A63F 5/04

[52] U.S. Cl. ..... 273/143 R; 403/224

[58] Field of Search ..... 273/143; 403/220, 224, 403/225, 226, 227

[56] References Cited

U.S. PATENT DOCUMENTS

| | | | |
|---|---|---|---|
| 1,763,841 | 6/1930 | Watling | 273/143 R |
| 2,565,606 | 8/1951 | Guy | 403/224 X |
| 3,913,922 | 10/1975 | Richards et al. | 273/143 R |
| 4,410,178 | 10/1983 | Partridge | 273/143 R |
| 4,621,815 | 11/1986 | Yamamoto | 273/143 R |

FOREIGN PATENT DOCUMENTS

| | | | |
|---|---|---|---|
| 2838339 | 11/1980 | Fed. Rep. of Germany . | |
| 115566 | 1/1982 | Japan | 273/143 R |
| 63-7268 | 1/1988 | Japan . | |
| 57-115566 | 1/1988 | Japan . | |
| 1323780 | 7/1987 | U.S.S.R. . | |
| 1255701 | 12/1971 | United Kingdom . | |
| 2126690 | 3/1984 | United Kingdom . | |

*Primary Examiner*—Anton O. Oechsle

[57] ABSTRACT

A reel driving device which comprises a drive disk having a drive shaft fixing boss for prohibiting the drive shaft from idling, and impact mitigating bosses for mitigating an impact force exerted by the motor, provided therein opposed to each other with respect to the drive shaft fixing boss; a reel having holes for receiving the drive shaft fixing boss and the impact mitigating bosses provided at corresponding positions thereof; and reel fixing means for prohibiting the reel from moving along the drive shaft.

17 Claims, 4 Drawing Sheets

REEL DRIVING DEVICE FOR USE IN THE SLOT MACHINE

BACKGROUND OF THE INVENTION

1. Field of the Invention

This invention relates to a reel driving device for use in the slot machine in which a reel is driven by a pulse motor or the like.

2. Related Background Art

In the conventional slot machine, reels are started to rotate by a rotating force caused by an impact force mechanically given by a lever operation and is caused to stop rotating by locking a paw preset for each symbol of each reel by pushing, e.g. a stop button. For judging a combination of symbols, the symbols of each reel have different signal grooves, and when the reels are stopped, a combination of symbols are judged based on their signal grooves.

But the conventional mechanically driven slot machine has a number of mechanical parts, which makes its structure complicated with results that costs are high and it is difficult to retain precision in fabricating them.

In view of such problems, recently the slot machine which is driven by the pulse motor has been used. In such slot machine, a signal for actuating the pulse motors of respective reels is generated by a lever operation to cause the pulse motors to rotate the reels, and the reels are stopped based on a signal for stopping the respective pulse motors generated by pushing a stop button. Symbols of the respective reels are judged by counting driving pulses supplied to the respective pulse motors and judging a combination of the counted signals by a microcomputer (Japanese Utility Model Publication No. 7268/1988, Japanese Utility Model Laid Open Publication No. 115566/1982 and U.S. Pat. No. 4,410,178).

Compared with the conventional mechanically driven slot machine, such pulse motor driven slot machine, in which the counted signal of the driving pulses is processed by a microcomputer to judge the symbols of the respective reels, has lower costs, lower possibility of abrasion and a drastically improved structure.

But, the pulse motor, which has a small torque with respect to a load of the reel accelerates the rotation of the reel considerably so lower compared with the mechanical drive that the rotation of the reel is not regular (awkward) and has low acceleration. That is, this results in a problem of poorer images compared with the mechanically driven slot machine.

Another problem with the pulse motor driven slot machine is that when the input of pulses to a pulse motor driving circuit is stopped to stop the pulse motor abruptly, the reel deviates at its stop position due to its inertia.

SUMMARY OF THE INVENTION

In view of the above described problems this invention aims at providing a reel driving device for use in the slot machine for driving a reel by a pulse motor which absorbs the inertia force of the reel with an elastic member so as to mitigate the inertia force, whereby the reel is driven at high acceleration and regularly, and less deviation occurs even when the reel is abruptly stopped.

This invention comprises a drive disk, a reel and reel fixing means. The drive disk has a drive shaft fixing boss for prohibiting the drive shaft from idling, and impact mitigating bosses for mitigating an impact force exerted by the motor, provided therein opposed to each other with respect to the drive shaft fixing boss. The reel has holes for receiving the drive shaft fixing boss and the impact mitigating bosses provided at corresponding positions thereof. The reel fixing means prohibit the reel from moving along the drive shaft.

In this invention having the above described structure, the inertia force of the reel generated in its operation is absorbed by the interaction among the drive disk having the drive shaft fixing boss and the impact mitigating bosses, the reel, and the reel fixing means. Consequently the inertia force of the reel generated in an operation of the reel is absorbed, and the reel deviates less when suddenly stopped.

The present invention will become more fully understood from the detailed description given hereinbelow and the accompanying drawings which are given by way of illustration only, and thus are not to be considered as limiting the present invention.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

DESCRIPTION OF THE PREFERRED EMBODIMENT

Figure 1:
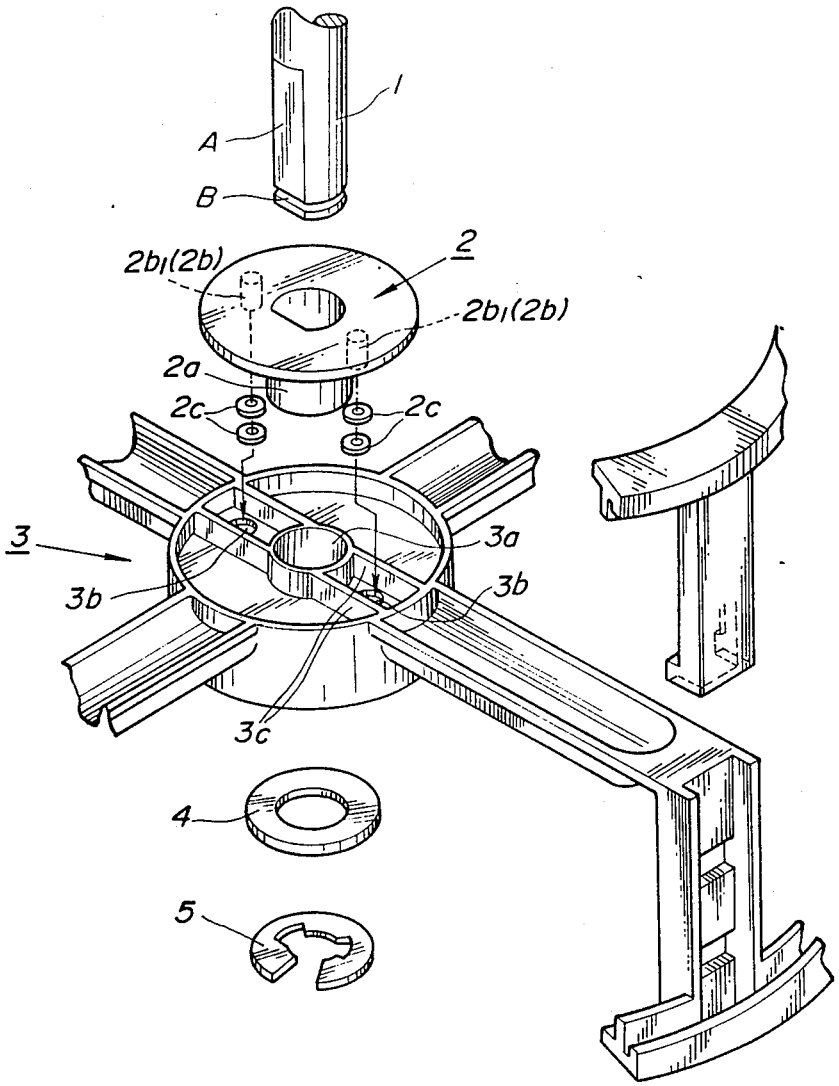
FIG. 1 is a broken perspective view of the reel driving device for use in the slot machine according to the first embodiment of this invention.

FIG. 1 is a broken perspective view including the reel driving device for use in the slot machine according to the embodiment of this invention. A drive shaft 1 of a motor has a flat surface (A) formed axially on the end portion thereof and a circumferential groove (B) formed in the tip of the end portion. Accordingly the section of the drive shaft of the motor contains a chord and an arc.

This embodiment basically comprises a drive disk 2, reel 3 and reel fixing means. Each element will be explained one by one.

In a drive disk 2 there are provided a drive shaft fixing boss *2a* which receives the drive shaft 1 of the motor, and impact mitigating boss members *2b*, *2b* which mitigate the impact force generated when the motor is actuated and is suddenly stopped. The shaft fixing boss *2a* is constructed so as to receive the drive shaft 1 of the motor and enables the drive shaft 1 to transmit the drive force of the motor to a reel disk without idling in the boss. The impact mitigating boss members *2b*, *2b* are arranged symmetrically to the drive shaft fixing boss, and the impact mitigating means each comprises a cylindrical member ***2b*1 and an O-ring *2c*** of, e.g., rubber, put around the cylindrical member.

In this embodiment the two cylindrical members 2b1 are arranged symmetrically and two O-rings 2c are put around each cylindrical member 2b1. The number of the cylindrical members 2b1, the distance between the drive shaft fixing boss and the respective impact mitigating bosses, and the number of the O-rings are variable depending on a generated impact force.

The shape of the impact mitigating bosses is not limited to a cylinder but may be, e.g., a polygonal cone or elliptical cone.

In the case that the impact mitigating boss is an elliptical cones, the bosses are so arranged that their major axes are laid in the radial direction. This arrangement is effective to absorb the impact force.

Instead of putting the O-rings on the cylindrical members, the impact mitigating bosses per se may be made of an elastic material.

A reel 3 has a first boss hole 3a for receiving the drive shaft fixing boss 2a, and second boss holes 3b, 3b for receiving the impact mitigating boss members 2b, 2b formed therein so as to receive the drive force from the drive disk 2. The first boss hole 3a is for aligning the drive shaft 1 of the motor and the rotary shaft of the reel 3. The second boss holes 3b, 3b are for transmitting the drive force to the reel 3 and mitigating the impact force. Accordingly, it is preferable that the impact mitigating boss members 2b, 2b are inserted in the second boss holes 3b, 3b without play therein. To this end, the inner diameter of the second boss holes 3b is made a little smaller that of the outer diameter of the cylindrical members 2b1 with the O-rings 2c, and the impact mitigating bosses 2b1, 2b1 are inserted in the second boss holes 3b, deforming the O-rings 2c. Instead of forming the second boss holes 3b, 3b , which hold the impact mitigating boss members 2b, 2b, reinforcing ribs 3c, 3c for reinforcing the reel 3 may be provided at an interval which allows the O-rings 2c, 2c to be held by the reinforcing ribs 3c, 3c. In this case, the extra second boss holes 3b, 3b do not have to be provided, which can simplify the fabrication of the reel 3 and improve the strength of the reel 3.

The reel fixing means comprise a washer 4 and E-ring 5. The washer 4 of which the outer diameter is bigger than the inner diameter of the first boss hole 3a at least, and of which the inner diameter is bigger than the outer diameter of the drive shaft 1, is used.

Next, how to assemble the drive disk 2, the reel 3 and the reel fixing means will be explained.

The reel 3 is assembled by mounting the drive disk 2 on the drive shaft 1, then inserting the drive shaft fixing boss 2a and the impact mitigating boss members 2b, 2b, of the drive disk 2 in the first boss hole 3a and the second boss holes 3b, 3b , of the reel 3, and inserting the drive shaft 1 into a washer 4. Finally an E-ring 5 is engaged in the groove in the drive shaft 1 so as to prohibit the axial displacement of the reel 3. The circumferential displacement of the reel 3 is prohibited by the drive shaft 1 being inserted in the drive shaft fixing boss 2a, and the axial displacement of the reel 3 is prohibited by the drive shaft 1 being inserted in the washer and E-ring 5.

Next, the operation of this embodiment will be explained. The drive force of the motor is transmitted from the drive shaft 1 to the drive shaft fixing boss 2a of the drive disk 2 and is transmitted from the impact mitigating boss members 2b, 2b to the second boss holes 3b, 3b of the reel 3. Accordingly, an impact force generated when the motor is driven elastically deforms the O-rings 2c put around the cylindrical members 2b1 provided in the drive disk 2, so that an inertia force of the reel 3 generated when the reel 3 is actuated is absorbed. An impact force generated when the motor is abruptly stopped is transmitted to the O-rings 2c and deforms the O-rings 2c, so that the deviation of the reel 3 is lessened when the reel 3 is stopped.

Figure 2:
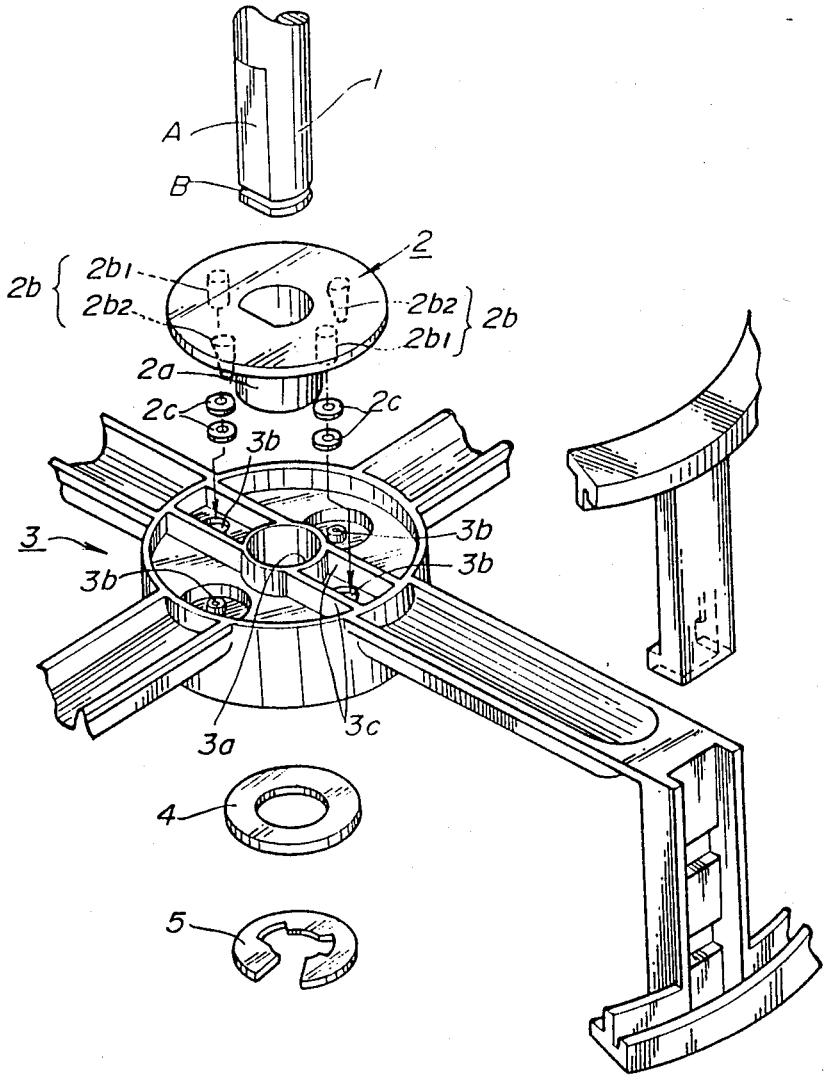
FIG. 2 is a broken respective view of the reel driving device for use in the slot machine according to the second embodiment.

FIG. 2 is a broken perspective view including the reel driving device for use in the slot machine according to another embodiment of this invention. This embodiment basically comprises a drive disk 2, a reel 3 and reel fixing means. The embodiment differs from the embodiment of FIG. 1 in that each impact mitigating boss members 2b comprises a conical member 2b2, 2b2 tapered toward the tip thereof. The shape and position of the conical members 2b2, 2b2 are variable, depending on an impact force resulting from the inertia force of the reel 3. In this embodiment, two conical members 2b2, 2b2 are provided equidistantly from the respective cylindrical members 2b1, 2b1. The second boss holes 3b, 3b which receive the conical members 2b2 , 2b2 are so arranged that only the tip portions of the conical members 2b2, 2b2 are received therein. Accordingly the flexibility of the constituent members can be fully exerted.

In this embodiment, both the cylindrical members 2b2, 2b1, and the conical members 2b2, 2b2 are used, but the conical members 2b2, 2b2 alone may be used. The other constituent members and their operation are the same as in the former embodiment, and their description is omitted.

The shape of the forward end portion of the drive shaft 1 of the motor is not limited to the shape of the embodiments (comprising an arc and a chord) but may be polygon, such as square, hexagon or others, or ellipse.

The number and the pitch of the impact mitigating bosses 2b 1 and 2b2 provided in the drive disk 2, and the distance between the center of the drive disk and the respective impact mitigating boss 2b1 and 2b2 are variable, depending on an impact force to be mitigated. Generally a suitable value is determined, based on experimental and empirical data.

It is experimentally proved that the above described embodiments improve the damper characteristic drastically compared with the prior art.

FIG. 3 shows modifications of a reel driving device for use in the slot machine according to this invention. FIG. 3A is a perspective view of the first modification of a drive disk composing the reel driving device. The difference from the embodiment described above (see FIG. 1) is that the impact mitigating boss members 2b comprise elastic ring members 2c and polygonal sectional members 2b1 inserted in the elastic ring members 2c.

Figure 3A:
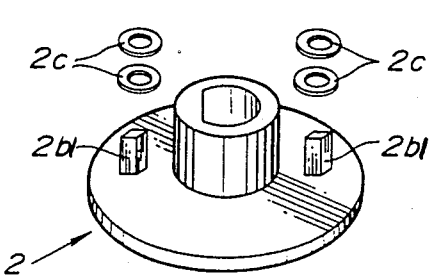
FIGS. 3A–3M are views of the reel driving device for use in the slot machine according to the modifications of this invention.
Figure 3B:
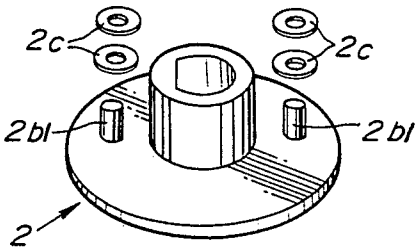

FIG. 3B is a perspective view of the second modification of the drive disk 2. The difference from the first modification (see FIG. 3A) is that the impact mitigating bosses comprise elastic ring members 2c, and elliptical sectional cylindrical members 2b1 inserted in the elastic ring members 2c.

Figure 3C:
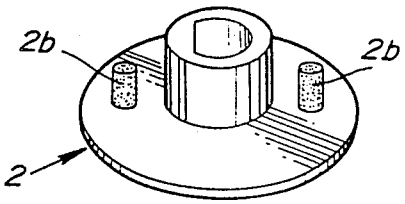

FIG. 3C is a perspective view of the third modification of the drive disk 2. The difference from the first modification (see FIG. 3A) is that the impact mitigating boss members 2b comprise elastic cylindrical members.

Figure 3D:
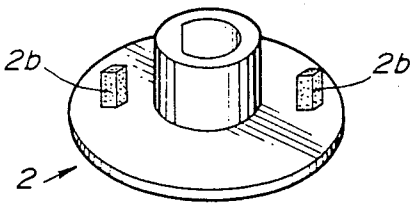

FIG. 3D is a perspective view of the fourth modification of the drive disk 2. The difference from the third modification (see FIG. 3C) is that the impact mitigating boss members 2*b* comprise polygonal sectional elastic members.

Figure 3E:
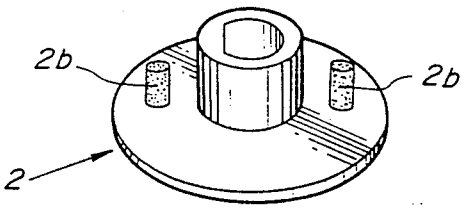

FIG. 3E is a perspective view of the fifth modification of the drive disk 2. The difference from the fourth modification (see FIG. 3D) is that the impact mitigating boss members 2*b* comprise elliptical sectional cylindrical elastic members.

Figure 3F:
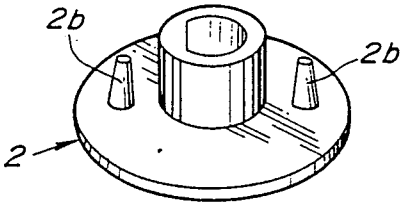

FIG. 3F is a perspective view of the sixth modification of the drive disk 2. The difference from the embodiment (see FIG. 1) is that the impact mitigating boss members 2*b* comprise conical members.

Figure 3G:
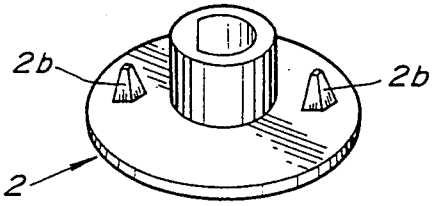

FIG. 3G is a perspective view of the seventh modification of the drive disk 2. The difference from the sixth modification (see FIG. 3F) is that the impact mitigating boss members 2*b* comprise polygonal conical members.

Figure 3H:
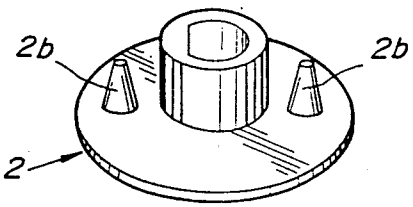

FIG. 3H is a perspective view of the eighth modification of the drive disk 2. The difference from the seventh modification (see FIG. 3G) is that the impact mitigating boss members 2*b* comprise elliptical conical members.

Figure 3K:
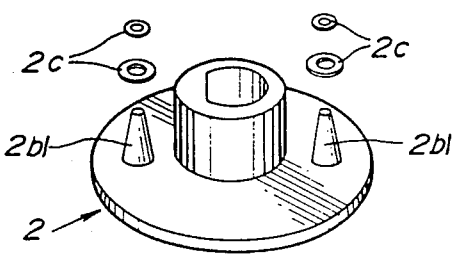
Figure 3J:
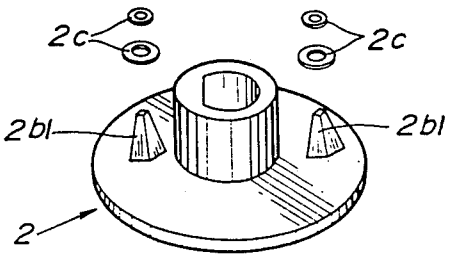
Figure 3I:
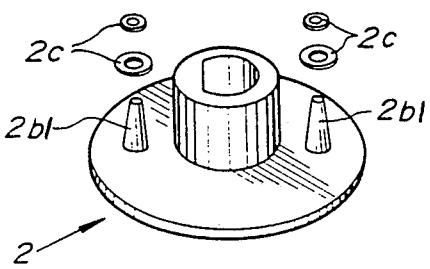

FIG. 3I is a perspective view of the ninth modification of the drive disk 2. The difference from the embodiment described above (see FIG. 1) is that the impact mitigating means comprise elastic ring members 2*c*, and conical members 2*b*1 inserted in the elastic ring member 2*c*.

FIG. 3J is a perspective view of the tenth modification of the drive disk 2. The difference from ninth modification (see FIG. 3I) is that the impact mitigating means comprise elastic ring members 2*c*, and polygonal conical members 2*b*1 inserted in the elastic ring members 2*c*.

FIG. 3K is a perspective view of the eleventh modification of the drive disk 2*c*. The difference from the tenth modification (see FIG. 3J) is that the impact mitigation means comprise elastic ring members 2*c*, and elliptical conical members 2*b*1 inserted in the elastic ring members 2*c*.

Impact mitigating bosses 2*b*1 and 2*b*2 described above are formed integral with drive disk 2. The impact mitigating bosses can be made integral with the device disk in anyone of the methods commonly relied upon by those persons skilled in the art.

Figure 3M:
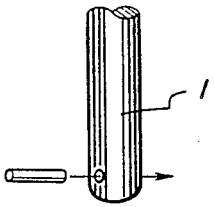
Figure 3L:
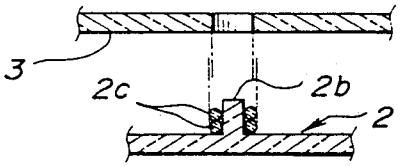

FIG. 3L is a sectional view of the modification of a reel composing the reel driving device. The difference from the embodiment described above (see FIG. 1) is that the reel 3 has impact mitigating boss holes having a little smaller inner diameter than the outer diameter of the elastic ring member 2*c* in its inserted state.

FIG. 3M is a perspective view of the modification of reel fixing means composing the reel driving device. The difference from the embodiment described above (see FIG. 1) is that the reel fixing means comprise a pin placed through the drive shaft 1.

From the invention being thus described, it will be obvious that the invention may be varied in many ways. Such variations are not to be regarded as a departure from the spirit and scope of the invention, and all such modifications as would be obvious to one skilled in the art are intended to be included within the scope of the following claims.

I claim:

1. A reel driving device comprising:

a drive disk having at the center thereof a drive shaft fixing boss for receiving a drive shaft of a motor and fixing the drive shaft relative thereto, and impact mitigating means including boss members for mitigating an impact force of said motor, said boss members being integral with said drive disk and being symmetrically disposed about said drive shaft fixing boss; and a reel having holes for receiving said drive shaft fixing boss and said impact mitigating boss members formed at corresponding positions thereon.

2. A reel driving device according to claim 1, wherein said impact mitigating boss members comprise cylindrical members and wherein said impact mitigating means further include elastic ring members encircling said cylindrical members.

3. A reel driving device according to claim 1, wherein said impact mitigating boss members comprise polygonal sectional members and wherein said impact mitigating means further include elastic ring members encircling said polygonal sectional members.

4. A reel driving device according to claim 1, wherein said impact mitigating boss members comprise elliptical sectional cylindrical members and wherein said impact mitigating means further include elastic ring members encircling said elliptical sectional cylindrical members.

5. A reel driving device according to claim 1, wherein said impact mitigating boss members comprise elastic cylindrical members.

6. A reel driving device according to claim 1, wherein said impact mitigating boss members comprise polygonal sectional elastic members.

7. A reel driving device according to claim 1, wherein said impact mitigating boss members comprise elliptical sectional cylindrical elastic members.

8. A reel driving device according to claim 1, wherein said impact mitigating boss members comprise conical members.

9. A reel driving device according to claim 1, wherein said impact mitigating boss members comprise polygonal conical members.

10. A reel driving device according to claim 1, wherein said impact mitigating boss members comprise elliptical conical members.

11. A reel driving device according to claim 1, wherein said impact mitigating boss members comprise conical members and wherein said impact mitigating means further include elastic ring members encircling said conical member.

12. A reel driving device according to claim 1, wherein said impact mitigating boss members comprise polygonal conical members and wherein said impact mitigating means further include elastic ring members encircling said polygonal conical members.

13. A reel driving device according to claim 1, wherein said impact mitigating boss members comprise elliptical conical members and wherein said impact mitigating means further include elastic ring members encircling said elliptical conical members.

14. A reel driving device according to claim 1, wherein said respective impact mitigating boss members are arranged equidistant from said drive shaft.

15. A reel driving device according to claim 1, wherein said impact mitigating boss members comprise a pair of conical members and a pair of cylindrical members and wherein each of said mitigating means further includes at least one elastic ring member encircling each of said conical and cylindrical members, said conical and cylindrical members arranged in a cross configuration with said fixing boss set at the intersection thereof.

16. A reel driving device according to claim 1, wherein said impact mitigating boss members comprise cylindrical members and wherein said impact mitigating means further include elastic ring members encircling said cylindrical members; and said reel has impact mitigating boss holes having a little smaller inner diameter than the outer diameter of said elastic ring member in its inserted state.

17. A reel driving device according to claim 1, wherein said reel comprises reinforcing ribs for holding said impact mitigating means therebetween.

* * * * *